US010182631B2

(12) United States Patent
Schifter

(10) Patent No.: US 10,182,631 B2
(45) Date of Patent: Jan. 22, 2019

(54) STANDARD APPEARING JEWELRY BOX WITH RECORDING AND PLAYBACK UPON OPENING

(71) Applicant: Daniel Schifter, Staten Island, NY (US)

(72) Inventor: Daniel Schifter, Staten Island, NY (US)

( * ) Notice: Subject to any disclaimer, the term of this patent is extended or adjusted under 35 U.S.C. 154(b) by 0 days.

(21) Appl. No.: 15/855,350

(22) Filed: Dec. 27, 2017

(65) Prior Publication Data

US 2018/0116358 A1 May 3, 2018

(51) Int. Cl.

| | |
|---|---|
| ***A45C 11/04*** | (2006.01) |
| ***A45C 11/16*** | (2006.01) |
| ***A45C 13/00*** | (2006.01) |
| ***A45C 15/00*** | (2006.01) |

(52) U.S. Cl.

CPC ..... *A45C 11/16* (2013.01); *A45C 13/001* (2013.01); *A45C 15/00* (2013.01)

(58) Field of Classification Search

CPC ..... A45C 11/16; A45C 13/001; A45C 15/00; A45C 11/04; A47F 7/02; A47F 7/03

USPC ..... 206/6.1, 459.1, 459.5, 523

See application file for complete search history.

(56) References Cited

U.S. PATENT DOCUMENTS

| | | | | |
|---|---|---|---|---|
| 6,259,794 | B1 | 7/2001 | Dobbins | |
| 6,405,858 | B1 * | 6/2002 | Gagliardi | A45C 11/16 206/566 |
| 6,675,511 | B2 | 1/2004 | Pines | |
| 7,600,336 | B2 | 10/2009 | Hermanson et al. | |
| 7,789,225 | B2 * | 9/2010 | Whiteis | A45C 11/00 206/6.1 |
| 7,837,038 | B2 | 11/2010 | Chang et al. | |
| 9,521,476 | B2 | 12/2016 | Spiridgliozzi | |
| 9,661,409 | B2 | 5/2017 | Leach et al. | |
| 2007/0115653 | A1 * | 5/2007 | Cea | A45C 11/16 362/104 |
| 2007/0295619 | A1 * | 12/2007 | Lee | A45C 11/16 206/6.1 |
| 2010/0294675 | A1 * | 11/2010 | Mangano | A45C 11/04 206/5 |
| 2013/0126379 | A1 * | 5/2013 | Medhal | B65D 55/14 206/459.1 |

(Continued)

OTHER PUBLICATIONS

Advertising material, https://www.amazon.com/EZSound-Box-Personal-Messages-Rerecordable, accessed Oct. 9, 2017, 13 pages.

(Continued)

*Primary Examiner* — Rafael A Ortiz

(74) *Attorney, Agent, or Firm* — Michael J. Feigin, Esq.; Feigin & Fridman

(57) ABSTRACT

A jewelry box with a depressable trigger button is used to detect when the box is open or closed. A hidden record button within the jewelry box allows one to record a message. When the box is opened, the recorded message is played back. An insert in the jewelry box, such as one which is compressible and resilient, is placed over the record button, as is, in some embodiments, a top side of a bottom of the box. Thus, the box looks like a typical jewelry box but on the insert, an indication of a place to press the record button can be placed. In this manner, one can record a message and surprise a loved one who opens the box expecting to find jewelry or the like within the box but also finds a personal message played back.

6 Claims, 5 Drawing Sheets

(56) References Cited

U.S. PATENT DOCUMENTS

| | | | | |
|---|---|---|---|---|
| 2013/0180880 | A1* | 7/2013 | Finkel | B65D 25/00 206/573 |
| 2014/0311936 | A1 | 10/2014 | Marks | |
| 2015/0001103 | A1* | 1/2015 | Huynh | A45C 11/16 206/6.1 |

OTHER PUBLICATIONS

Web site to record messages and reviews related to Veuve Clicquot Champagne https://www.thewhiskyexchange.com/p/31812/veuve-clicquot-rose-champagnecall-box-record-your-message, accessed Oct. 9, 2017, 2 pages.

* cited by examiner

STANDARD APPEARING JEWELRY BOX WITH RECORDING AND PLAYBACK UPON OPENING

FIELD OF THE DISCLOSED TECHNOLOGY

The disclosed technology relates generally to containers and, more specifically, to a jewelry box which plays audible sounds.

BACKGROUND OF THE DISCLOSED TECHNOLOGY

Rings, bracelets, and precious stones often come in jewelry boxes but the giver often has to stutter to get the words out to express his feelings which go along with the gift. Further, when jewelry boxes are shipped to others due to the large distance, the gift becomes less personal. A way of making a gift more personal and unique and increasing the joy of receiving the gift, as well as removing some of the angst around the giving is needed, but to do this in a "classy" way without breaking the bank is difficult. How does one gift a gift when they aren't available to tell the receiver how much they care about them or cannot get the words to come out on the spot? This and other problems in the present art are solved by the disclosed technology.

SUMMARY OF THE DISCLOSED TECHNOLOGY

A re-recordable jewelry box of embodiments of the disclosed technology has a bottom portion with an inner bottom wall, an outer bottom wall, and side walls. Between the inner and outer bottom wall electronics, switches, memory, processors, and the like are stored in embodiments of the disclosed technology. "Outer" for purposes of this disclosure is on the exterior or 'convex' sides of the box while "inner" is what is inside the box or on the 'concave' sides of the box. The outer sides are visible or substantially whether the box is open or closed while the inner sides are visible only when visible, in some instances, when the box is open but cannot be viewed from outside the box when the box is closed.

A trigger button at a top edge of one of the side walls detects whether the box is open or closed because when the box is closed, the trigger bottom is depressed, such as when a top cover is placed over and touching the bottom portion of the box along some or all top edges or close enough there-to to depress the trigger. The top cover fits over said bottom portion and when touching said side walls and depresses the trigger button in some embodiments of the disclosed technology.

A record button is triggered by depressing a portion of the inner bottom wall in embodiments of the disclosed technology. A compressible and resilient insert is removably placed over the inner bottom wall in embodiments of the disclosed technology. "Compressible" is defined as able to have at least a 20% decrease is any one cardinal direction, or in some embodiments, at least a 50% decrease. "Resilient" is defined as substantially or fully returning to the original size upon the forces causing compression being released. Such an insert is unconnected and/or unfastened to the box in embodiments of the disclosed technology, and merely remains in place relative to the bottom portion of the box due to friction and/or gravity. The insert can extend to each side wall and the record button is depressible by compressing the insert at a location over the record button. For purposes of this disclosure, "top", "bottom", and "sides" are relative to one typical orientation of the box, with the bottom being a side adjacent to/at the edge of the "bottom portion" to the exclusion of the oppositely disposed top cover and the top being a side adjacent to/at the edge of the "top cover" to the exclusion of the bottom cover. However, in some embodiments, the top cover can extend all the way to the bottom, and in such an embodiment, the top cover is the cover which is exterior to the bottom cover.

A data storage medium, audio recording device, and processor are held between the inner bottom wall and the outer bottom wall in embodiments of the disclosed technology. Each are electrically coupled or interfaced with one or more of such device devices such that the processor carries out instructions causing the audio device to record when the record button is depressed, capturing audio and storing the audio on the storage medium such as read/write memory (RAM), flash storage, or the like.

Upon the top cover being removed from the bottom portion, in embodiments of the disclosed technology, the trigger button extends upwards out of a plane defined by the top edge of a side wall of the box, and the audio stored on the data storage medium is played back through a speaker within the box. In some embodiments, audio previously recorded using a microphone hidden within the box is played back through a speaker hidden within the box. A sticker is placed over a portion of the insert corresponding to a position of the record button beneath the sticker, in some embodiments of the disclosed technology. The record button functions, in some embodiments of the disclosed technology, only when the trigger button at the top edge of one of the side walls extends upwards from a plane defined by the top edge of the side wall(s).

Said another way, a re-recordable jewelry box of embodiments of the disclosed technology has a microphone, speaker, recording medium, and record button held within a jewelry box and hidden from view whether the jewelry box is open or closed. The record button is configured to cause the microphone to record audio (converted to digital signals and stored) into the recording medium. A trigger switch is triggered by opening the jewelry box which, in turn, is configured to cause the speaker to play audio recorded into/on the recording medium.

The trigger switch can be a depressible switch extending out of a top edge of a bottom portion of the jewelry box, the bottom portion enclosing a larger area between its sides than a top cover, the top cover configured to depress the trigger switch when the top cover and the bottom portion enclose a space between each other.

The record button is situated between a compressible and resilient insert, in embodiments of the disclosed technology, the insert being sized to fit across some of, or an entire bottom side of the jewelry box. An indication on the insert (such as a different color, words, a stickier, a symbol, indicia) indicates where to compress the insert to cause the microphone to record the audio into the recording medium.

The bottom portion of the jewelry box, in embodiments of the disclosed technology, has enclosed therein and hidden from external view, the microphone, speaker, recording medium, and record button. All of this can be between the insert and a side opposite the top edge (of the side walls, e.g. the bottom).

The record button is activatable only when the jewelry box is open, as determined by the trigger switch in some embodiments of the disclosed technology.

A method of recording a message into a re-recordable jewelry box, in embodiments of the disclosed technology, can be carried out by removing a top cover of the jewelry box from a bottom portion, depressing a compressible and resilient insert held within the jewelry box until a record button beneath the insert is activated, recording sound into a recording device hidden within the jewelry box, and placing the top cover on the bottom portion. Then the jewelry box is given to another to open. When the other person opens the jewelry box, as intended by the person who gives the jewelry box to this other person, the recorded message is played back after a trigger switch in a top edge of the bottom portion is extended.

Any device or step to a method described in this disclosure can comprise, or consist of, that which it is a part of, or the parts which make up the device or step. The term "and/or" is inclusive of the items which it joins linguistically, and each item by itself.

DETAILED DESCRIPTION OF EMBODIMENTS OF THE DISCLOSED TECHNOLOGY

A jewelry box with a depressable trigger button is used to detect when the box is open or closed. A hidden record button within the jewelry box allows one to record a message. When the box is opened, the recorded message is played back. An insert in the jewelry box, such as one which is compressible and resilient, is placed over the record button, as is, in some embodiments, a top side of a bottom of the box. Thus, the box looks like a typical jewelry box but on the insert, an indication of a place to press the record button can be placed. In this manner, one can record a message and surprise a loved one who opens the box expecting to find jewelry or the like within the box but also finds a personal message played back.

Embodiments of the disclosed technology will become more clear in view of the following description of the figures.

Figure 1:
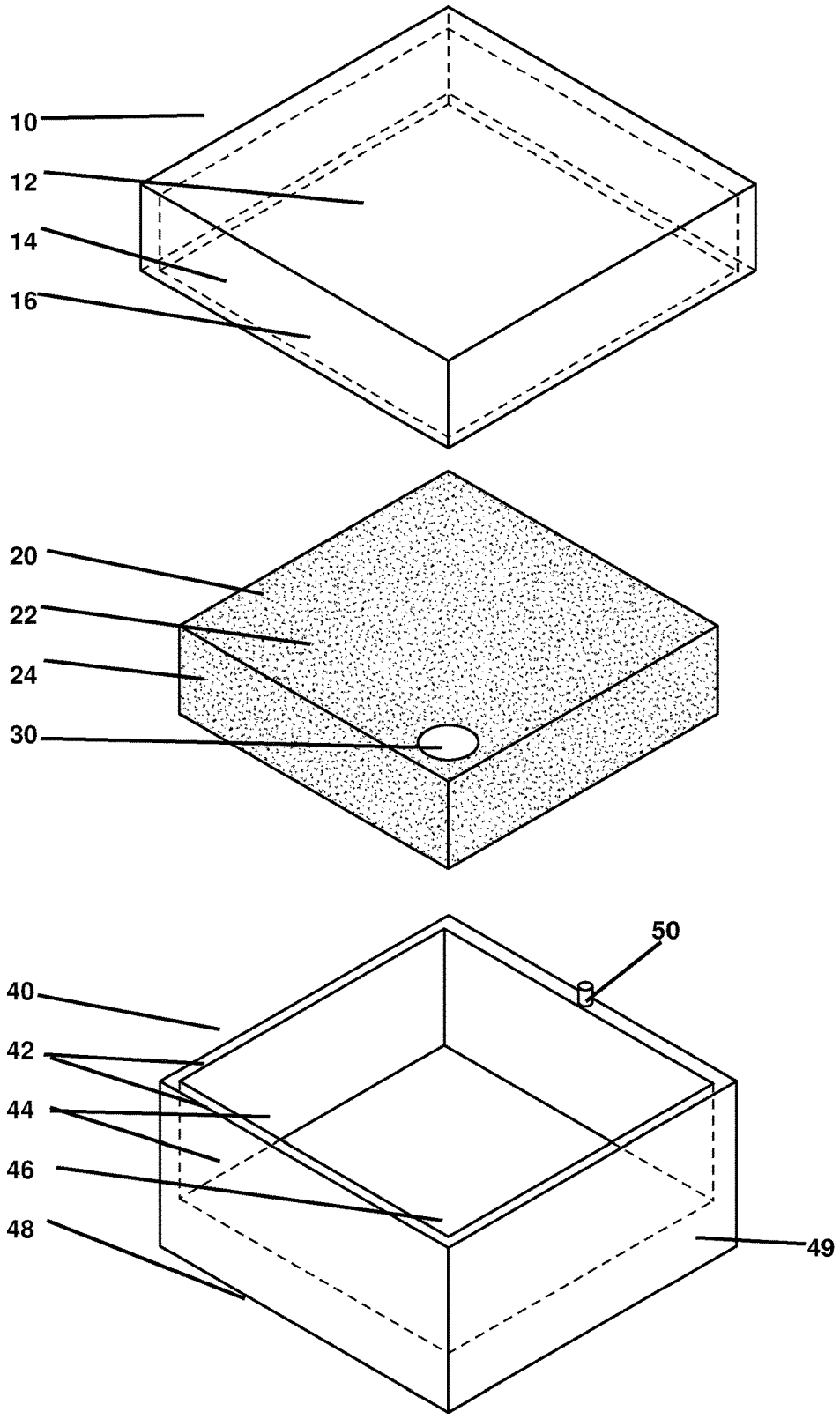
FIG. 1 shows a expanded view of the jewelry box cover, insert, and bottom portion in an embodiment of the disclosed technology.

FIG. 1 shows a expanded view of the jewelry box cover, insert, and bottom portion in an embodiment of the disclosed technology. The top cover 10 has a top side 12, left, right, front, and back sides 16, and a bottom edge formed from the bottom edges of the side walls 14. The "top" side is the one where the cover 10 is relative to the "bottom" side which is where, relative to the top cover 10, the bottom portion 40 of the box is located. The top cover 10 encloses an interior space 16 bound by an open bottom side, side walls 14 and top wall 12. The interior space 16 has a length and width wider than that of the top edges 42 of the bottom portion of the jewelry box such that the top cover 10 frictionally fits over and is held to the bottom portion 40 in embodiments of the disclosed technology.

The bottom portion 40 has top edges 42 which point towards the lower side of the top portion 10 of the jewelry box. On the top edge is a trigger switch 50 which is used to determine if the box is open or closed. In the embodiment shown, the trigger switch 50 becomes depressed when the top cover 10 is placed there-on the top edge of 42 of the bottom portion of the box. The trigger switch can be spring loaded or use oppositional magnetic forces to remain above a plane defined by the top edges 42 of the bottom portion of the box, but be pushable downwards by forces such as the box cover 10 and the underside thereof being placed on the trigger switch 50 and/or touching the top edge 42 of the lower portion of the box 40. The trigger switch can be electrically or mechanically coupled to open or close a circuit when enables or disables the electronics of the device. For example, the trigger switch 50, when depressed, may disconnect a battery from other electronics in the device, thereby preserving battery power. When the cover is removed, the trigger switch 50 can connect, via an electrical circuit, the battery to electronics of the device and when a processor receives power, it sends instructions to play a message stored into memory.

Referring again to the bottom portion 40 of the box, the bottom portion has side walls 44 and a bottom side 48 which join to enclose an interior space 46 on five sides. The upper side of the bottom wall 48 faces towards the lower side 12 of the top cover when the box is closed defining the upper and lower limits of an interior space of the box, the sides being defined by the side walls 44, and in some cases, part of side walls 14. Between upper and lower extends of the bottom 48 of the bottom portion 40 of the box is an enclosed area 49 where electronics (such as processor, memory, speaker, battery, microphone, and storage medium) are held within, hidden from view. "Hidden" is defined as "invisible to a person looking directly at an object from any side, such as by being blocked or surrounded by another object." The enclosed area 49 is below the interior space 46 and above the bottom edge 48 of the bottom portion of the box in embodiments of the disclosed technology. A button, such as a hidden button, can be beneath the upper surface (where line 46 extends to in FIG. 1) of the bottom portion such that depression of the upper surface causes the button to be pressed. This upper surface of the bottom portion 40 is substantially or completely (within an acceptable tolerance level known in the art) flat and/or planar. The depression can be slight and undetectable to the naked eye. Thus, to a person examining the box, the box appears as a "regular" jewelry box. That is, no signs of differentiation on the jewelry box are visible ("visible" being defined as the opposite of "hidden"), such differentiations being related to the addition of electronics or electronic components to the jewelry box.

Elucidating further on the concept of what a jewelry box is, for purposes of this disclosure, a jewelry box is a defined as a box which has a top cover removably from a larger bottom portion. The removing of the top cover can be a complete separation or an angling of the top portion away from the bottom portion, and the top and bottom can still be connected or touch each other while being separated in embodiments of the disclosed technology. A "normal" jewelry box, for purposes of this disclosure, lacks any electronic components. The electronic jewelry box of the disclosure has at least a battery, speaker, storage medium, and processor and can have additional electronic components. Electronic components are those which are powered by or store electric current to carry out a function which requires or uses the electric current to do so.

Referring still to FIG. 1, the insert 20 is a resilient and compressible pad in embodiments of the disclosed technology. The insert can have side walls 24 which are sized to fit snugly within the interior space 46 of the bottom portion or section 40 of the box. "Snugly" as defined as "held on more than one side by frictional forces and/or abutment with another object on more than one side." A top side 22 of the insert 20 faces upwards towards the interior space 12 of/or the top cover 10. On this top side 22, an indicia 30 can be placed. Given that the record button is invisible to the viewer and beneath the insert 20 in embodiments of the disclosed technology, the indicia 30 tells a person where to press in order to record a greeting. This indicia can be a sticker on the insert 20, a change in color of the insert 20, or any other indication to a user that this is the location where one should press in order to record. When the insert, which is resilient (able to return substantially to its original shape after being compressed) and compressible, is pressed or pressed and held, the record function of the electronics (see FIG. 4) is activated. When the button is released, the record function is deactivated in embodiments of the disclosed technology. After recording, a user may decide to remove the indicia 30 as such an indicia is the only viewable difference between a normal jewelry box and the electronic jewelry box in the embodiments of the disclosed technology. When the indicia is a sticker, one simply removes the sticker. Or, alternatively, one can turn over the insert 20 such that the indicia 30 is hidden from view even with the box opened.

Figure 2:
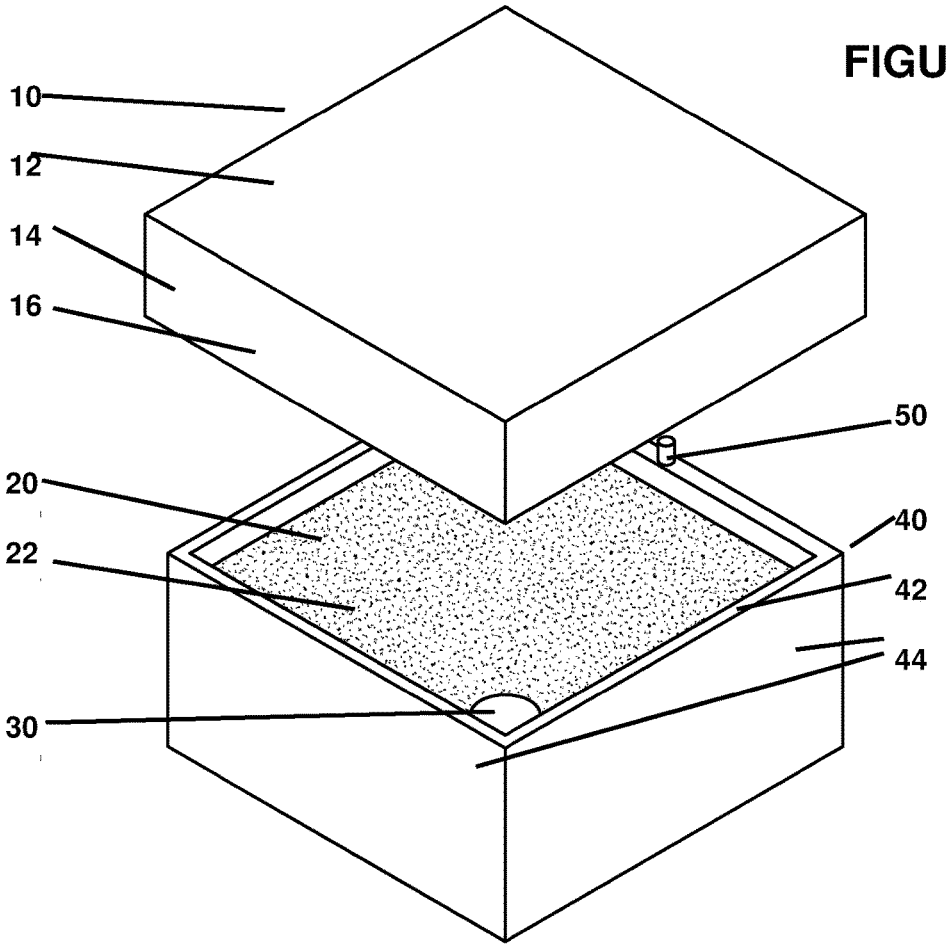
FIG. 2 shows the box cover above the bottom portion of the box in an embodiment of the disclosed technology.
Figure 3:
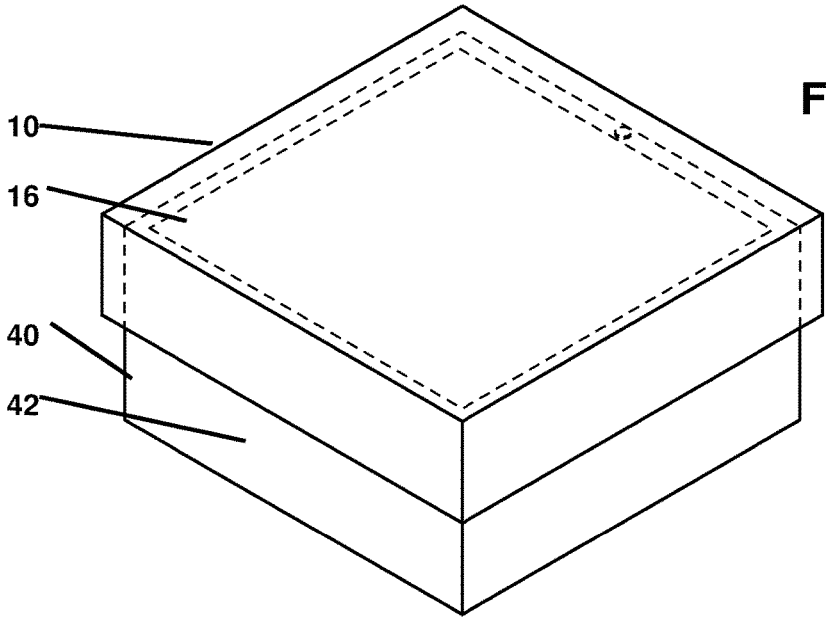
FIG. 3 shows a closed jewelry box of embodiments of the disclosed technology.

FIG. 2 shows the box cover above the bottom portion of the box in an embodiment of the disclosed technology. FIG. 3 shows a closed jewelry box of embodiments of the disclosed technology. Here, one can see the outline in dotted lines in FIG. 3 showing the position of the top cover 10 over the bottom portion 40 of the box. The side walls 44 are partially covered by the side walls 14 of the top portion 10, the top 12 of the top cover 10 forms the top of the closed box, and the enclosed space 16 and 46 (numbered in FIG. 1) are joined together as one enclosed space. The trigger switch 50 is depressed (shown in FIG. 3) by the top cover 10 pressing down there-on. The top cover is also touching, in this embodiment, the top walls 42 of the bottom portion.

Figure 4:
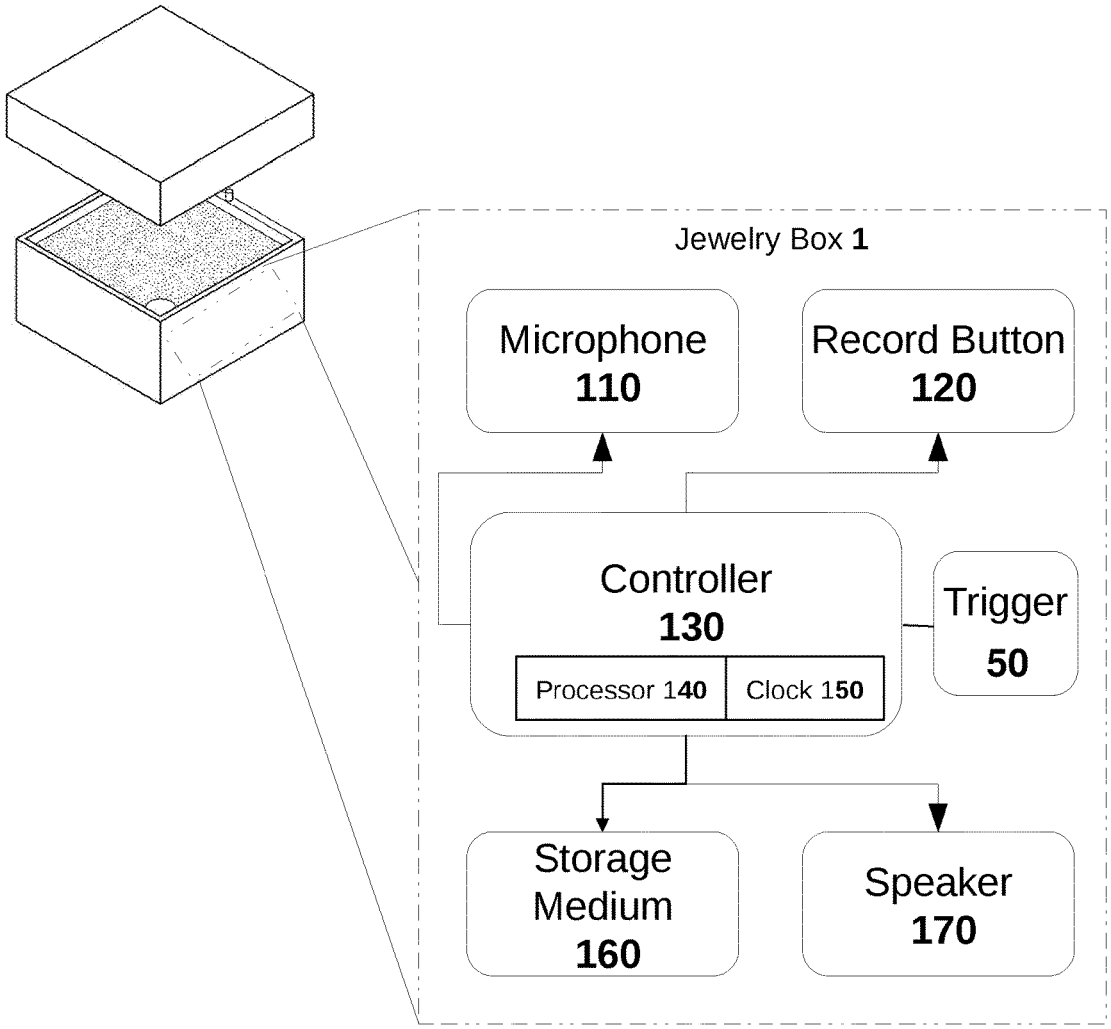
FIG. 4 shows electric elements hidden with the jewelry box of embodiments of the disclosed technology.

FIG. 4 shows electric elements hidden with the jewelry box of embodiments of the disclosed technology. The electric elements are held within the bottom portion 40 of the jewelry box 1, hidden from view. In embodiments of the disclosed technology, the electronic (or electric) components are under the insert 20 and above a bottom side of the bottom portion 40. These can include a microphone 110 used for converting acoustic sound waves into electrical impulses which are recorded on a storage medium 160 (such as a read/write storage system including a solid state storage medium which is tangible and a physical device). The trigger button 50 (see FIGS. 1-3) is further electrically coupled or connected to the electronic components or causes a switch to have a changed state such that the triggered state of the button 50 is detected. When the trigger button 50 is depressed, in embodiments of the disclosed technology, electric current from a battery to one or more of the rest of the electric components is turned off to conserve electricity. When the trigger is allowed to extend, such as when the top cover is removed from the box, electricity to the electric devices (110, 120, 130, 160, and/or 170) is disconnected. As soon as electricity is restored (when the trigger 50 is depressed) the controller 130 powers on and the processor 140 causes data stored in the storage medium 160 to be read and converted into acoustic waves by the speaker 170 which plays a version of the recorded message. The message is or was recorded by pressing the record button 120 (with the cover 10 off the trigger button 50) causing sounds entering the microphone 110 to be recorded onto the storage medium 160. The controller 130 controls some or all of the aforesaid actions, while the processor 140 carries out instructions to cause the actions and a clock 150 is associated with the processor 140, such that the processor 140 carries out a set of instructions with each clock tick. The recording can be as long as available to store on the storage medium 160, as long as the button 120 is pressed, or to a preset amount of record time which is measured by way of the clock 150 and/or processor 140.

Figure 5:
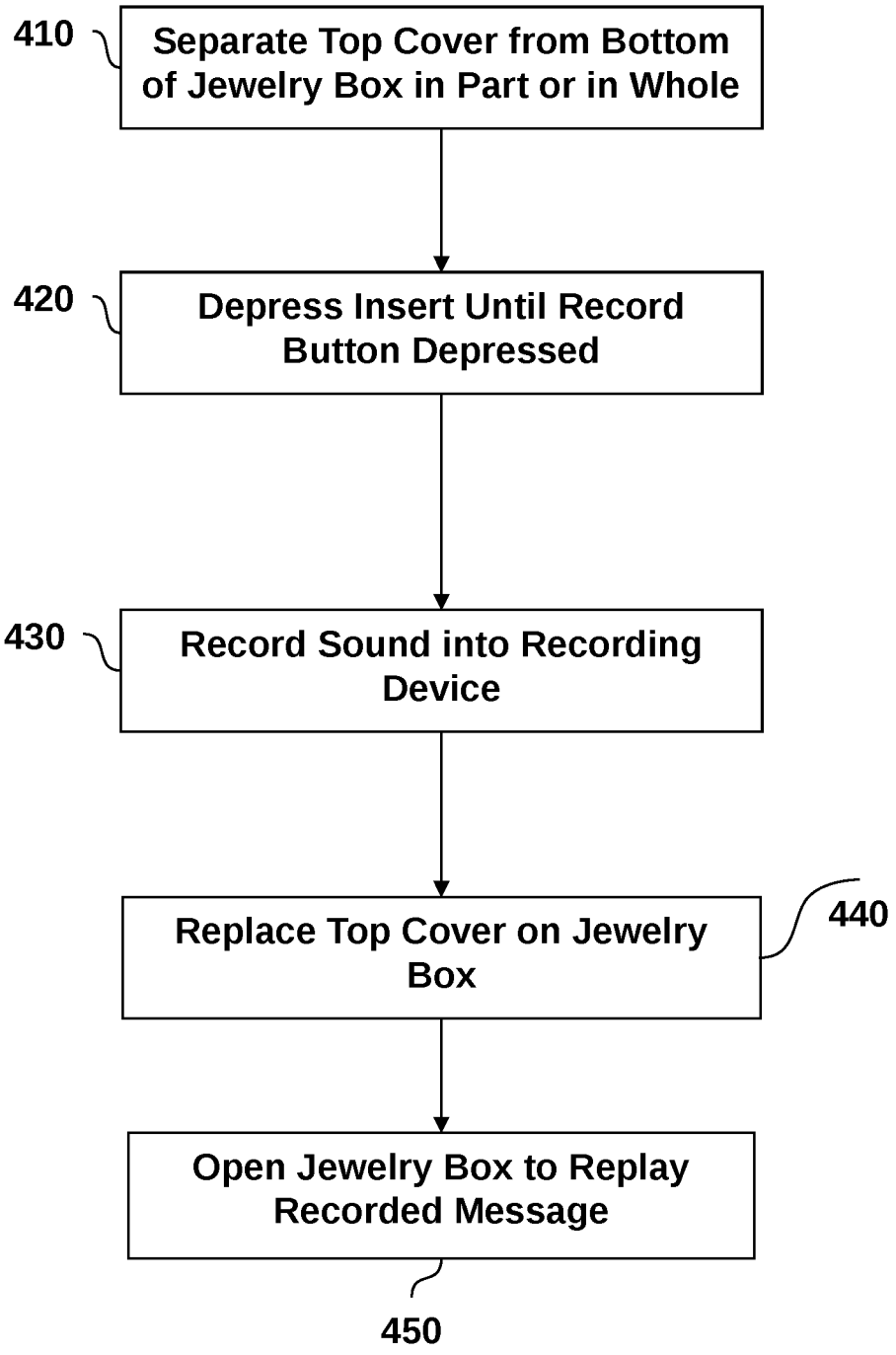
FIG. 5 shows a flow chart of a method of carrying out embodiments of the disclosed technology.

FIG. 5 shows a flow chart of a method of carrying out embodiments of the disclosed technology. In step 410, the top cover is separated from the bottom cover in whole or in part which releases a trigger switch or another mechanism indicating that the box is open. To record a message, one depresses an insert until a record button is also depressed, the record button being hidden from view in embodiments of the disclosed technology. One must compress the insert in order to effectively cause the record button to be pressed. Then, one records a sound into the device in step 430 by speaking into a microphone (which can be hidden). In an alternative embodiment, a sound is recorded on an external device and stored on a removable storage medium which is inserted into a port within the jewelry box, such as a hidden port adapted/designed to receive the memory card which is a form of a storage medium 160. Then, in step 440, the top cover of the jewelry box is replaced and one gives the jewelry box to another to open. Upon opening the jewelry box, as intended by the giver, the recorded message or a version thereof is played back in step 450.

Figure 6:
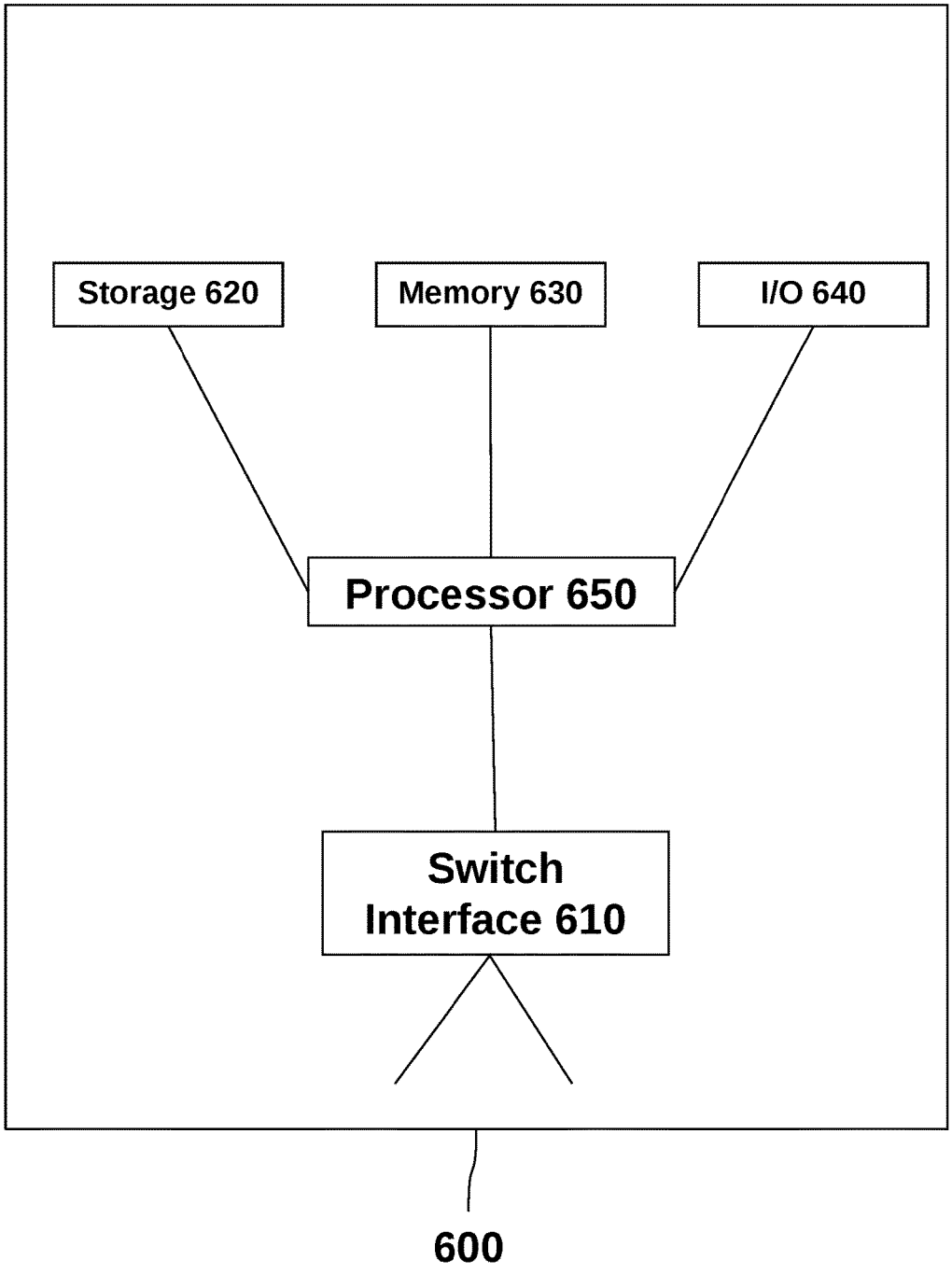
FIG. 6 shows a high level block diagram of devices which can be used to carry out embodiments of the disclosed technology.

FIG. 6 shows a high level block diagram of devices which can be used to carry out embodiments of the disclosed technology. Device 600 comprises a processor 650 that controls the overall operation of the computer by executing the device's program instructions which define such operation. The device's program instructions may be stored in a storage device 620 (e.g., magnetic disk, database) and loaded into memory 630, when execution of the console's program instructions is desired. Thus, the device's operation will be defined by the device's program instructions stored in memory 630 and/or storage 620, and the console will be controlled by processor 650 executing the console's program instructions. A device 600 also includes one, or a plurality of, input network interfaces for communicating with other devices via a network (e.g., the Internet). The device 600 further includes an electrical input interface. A device 600 also includes one or more output network interfaces 610 for communicating with other devices. Device 600 also includes input/output 640, representing devices which allow for user interaction with a computer (e.g., display, keyboard, mouse, speakers, buttons, etc.). One skilled in the art will recognize that an implementation of an actual device will contain other components as well, and that FIG. 4 is a high level representation of some of the components of such a device, for illustrative purposes. It should also be understood by one skilled in the art that the method and devices depicted in FIGS. 1 through 5 may be implemented on a device such as is shown in FIG. 6.

Further, it should be understood that all subject matter disclosed herein is directed, and should be read, only on statutory, non-abstract subject matter. All terminology should be read to include only the portions of the definitions which may be claimed. By way of example, "computer readable storage medium" is understood to be defined as only non-transitory storage media.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A re-recordable jewelry box comprising:

a bottom portion with an inner bottom wall, an outer bottom wall, and side walls;

a trigger button at a top edge of one of said side walls;

a top cover which fits over said bottom portion and when touching said side walls, depresses said trigger button;

a record button which is triggered by depressing a portion of said inner bottom wall and which functions only when said trigger button extends about said top edge of said one of said side walls;

a compressible and resilient insert over said inner bottom wall and substantially extending to each of said side walls, wherein said record button is depressible by compressing said insert at a location over said record button, wherein said record button functions only when said trigger button at said top edge of one of said side walls extends upwards from a plane defined by said top edge wherein a sticker is placed over a portion of said insert corresponding to a position of said record button beneath said sticker.

2. A re-recordable jewelry box, comprising:

a microphone, speaker, recording medium, and record button held within a jewelry box and hidden from view whether the jewelry box is open or closed;

said record button configured to cause said microphone to record audio into said recording medium when there a combination of said record button being pressed and a trigger switch being triggered;

said trigger switch being triggered by opening said jewelry box, wherein said opening further causes said speaker to play said audio recorded into said recording medium, said trigger switch being separate from said record button;

wherein said microphone records said audio and said play of said audio recorded into said medium is activatable only when said jewelry box is open, as determined by said trigger switch; and wherein said trigger switch is a depressible switch extending out of a top edge of a bottom portion of said jewelry box, said bottom portion enclosing a smaller area between its sides than a top cover which is configured to surround said top edge and each other top edge of said bottom portion, said top cover configured to depress said trigger switch when said top cover and said bottom portion enclose a space between each other.

3. The jewelry box of claim 2, wherein said record button is situated below a compressible and resilient insert, said insert being sized to fit across an entire bottom side of said jewelry box.

4. The jewelry box of claim 3, further comprising an indication on said insert, indicating where to compress said insert to cause said microphone to record said audio into said recording medium.

5. The jewelry box of claim 4, wherein said bottom portion of said jewelry box comprises said microphone, speaker, recording medium, and record button between said insert and a side opposite said top edge.

6. A re-recordable jewelry box, comprising:

a microphone, speaker, recording medium, and record button held within a jewelry box and hidden from view whether the jewelry box is open or closed;

said record button configured to cause said microphone to record audio into said recording medium when there a combination of said record button being pressed and a trigger switch being triggered;

said trigger switch being triggered by opening said jewelry box, wherein said opening further causes said speaker to play said audio recorded into said recording medium, said trigger switch being separate from said record button;

wherein said microphone records said audio and said play of said audio recorded into said medium is activatable only when said jewelry box is open, as determined by said trigger switch, wherein said record button is operated by depressing a top side of an interior region of said jewelry box, said top side being planar and remaining substantially planar during said depressing and being surrounded by four walls extending above said top side.

* * * * *